US008017189B2

(12) United States Patent
Schaedler et al.

(10) Patent No.: US 8,017,189 B2
(45) Date of Patent: Sep. 13, 2011

(54) RECORDING MATERIALS FOR INK-JET PRINTING

(75) Inventors: Volker Schaedler, Maikammer (DE); Chrystelle Egger, Timperley (GB); Roland Ettl, Ketsch (DE); Wolfgang Schmidt, Georgsmarienhuette (DE); Frank Konietzni, Osnabrueck (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 481 days.

(21) Appl. No.: 12/096,662

(22) PCT Filed: Nov. 30, 2006

(86) PCT No.: PCT/EP2006/069108

§ 371 (c)(1),
(2), (4) Date: Jun. 9, 2008

(87) PCT Pub. No.: WO2007/065841

PCT Pub. Date: Jun. 14, 2007

(65) Prior Publication Data

US 2008/0305286 A1 Dec. 11, 2008

(30) Foreign Application Priority Data

Dec. 9, 2005 (DE) ..... 10 2005 059 321

(51) Int. Cl.
*B05D 3/02* (2006.01)

(52) U.S. Cl. ..... 427/384; 427/487; 427/243; 427/385.5; 427/392; 427/396

(58) Field of Classification Search ..... None
See application file for complete search history.

(56) References Cited

U.S. PATENT DOCUMENTS

| | | | | |
|---|---|---|---|---|
| 5,525,573 | A | 6/1996 | Uemura et al. | |
| 6,265,059 | B1 | 7/2001 | Kono et al. | |
| 2003/0162009 | A1 | 8/2003 | Cuch et al. | |
| 2004/0265515 | A1 * | 12/2004 | Lingier et al. | 428/32.34 |
| 2007/0173552 | A1 * | 7/2007 | Schadler et al. | 521/65 |

FOREIGN PATENT DOCUMENTS

| | | | |
|---|---|---|---|
| EP | 0 191 645 | A2 | 8/1986 |
| EP | 1 020 300 | A1 | 7/2000 |
| EP | 1 101 624 | A2 | 5/2001 |
| JP | 7-81211 | | 3/1995 |
| JP | 9-263038 | | 10/1997 |
| WO | WO 97/22476 | | 6/1997 |
| WO | WO2005/049708 | * | 6/2005 |

OTHER PUBLICATIONS

Bulente Yoldas, "Design of Sol-Gel Coating Media for Ink-Jet Printing", Journal of Sol-Gel Science and Technology 13, 1998, pp. 147-152.

* cited by examiner

*Primary Examiner* — Erma Cameron
(74) *Attorney, Agent, or Firm* — Oblon, Spivak, McClelland, Maier & Neustadt, L.L.P.

(57) ABSTRACT

A process for producing a recording material printable with an ink jet printer and having a gel layer for that purpose comprises a) coating a support with a dispersion or solution of an organic gel former that is chemically crosslinkable by polycondensation or poly adduct formation, b) then effecting gel formation by polycondensation or poly adduct formation, and c) finally drying the gel.

18 Claims, No Drawings

RECORDING MATERIALS FOR INK-JET PRINTING

This invention relates to a process for producing a recording material printable with an ink jet printer and having a gel layer for that purpose, which comprises a) coating a support with a dispersion or solution of an organic gel former that is chemically crosslinkable by polycondensation or polyadduct formation, b) then effecting gel formation by polycondensation or polyadduct formation, and c) finally drying the gel.

This invention further relates to the substrates, especially papers, for ink jet printing that are obtainable by this process.

In ink jet printing, ink is applied from a stock reservoir vessel to the substrate to be printed; in the drop-on-demand process, the stock reservoir vessel moves and the ink is applied at the desired location; in the continuous drop process, a continuous jet of ink on its way to the substrate is deflected, for example by electrostatic charging, such that the marking appears on the substrate at the desired location in the desired shape and color.

Papers for ink jet printing are commonly constructed of a plurality of layers. The base paper supports a barrier layer to stop ink diffusing into the base paper. On top of the barrier layer is the ink receiving layer. Only the ink receiving layer absorbs the printing ink. A high quality of image requires that a very large amount of ink shall be absorbable. At the same time, printing and the subsequent drying shall require only a very short time.

The quality of the image and also the length of the printing step are therefore essentially determined by the properties of the ink receiving layer. Hitherto the ink receiving layer has typically comprised inorganic pigments for absorbing the printing ink. For example, ink receiving layers composed of colloidal silicates or aluminates are described in Journal of Sol-Gel Science and Technology 13, 147-152 (1998). The pigments are bound with polyvinyl alcohol binder and consolidated to form a porous three-dimensional structure (gel layer).

Papers for ink jet printing are relatively costly because of their complicated layered construction and, more particularly, because of their high level of inorganic pigments. Such papers could be distinctly less costly if the inorganic pigments were replaced by less costly raw materials. But the properties of the papers should ideally not be impaired. Therefore, printability, including in particular the printing and drying speed, and also image quality shall meet high requirements even without inorganic pigments.

Ink receiving layers composed of organic polymers have already been described. According to U.S. Pat. No. 6,265,059, emulsion polymers are coagulated to form the ink receiving layer. EP-A 191 645 describes an ink receiving layer comprising a polymer complex of an acidic polymer and a basic polymer.

EP-A 1 020 300 describes a mixture of two polymers which dries to form a gel.

JP-A 7081211 relates to the production of an ink receiving layer by irradiation of a water soluble polymer, for example a polyacrylic acid or polyacrylamide.

Prior art organic polymer ink receiving layers have unsatisfactory properties.

It is an object of the present invention to provide a process for producing recording materials for ink jet printing with a reduced level or complete absence of inorganic pigments in the ink receiving layer without jeopardizing the good performance characteristics of the papers.

We have found that this object is achieved by the process defined at the beginning. The present invention further provides the recording materials obtainable by this process and also for the use of the recording materials for ink jet printing.

Concerning Process Step a)

The support used can be any desired substrate; preferably it is a cellulosic substrate, in particular a base paper, more preferably base paper provided, at least on the side to be coated, with a barrier layer, for example of polyethylene. The barrier layer prevents the penetration of ink into the base paper. More preferably, the base paper has a barrier layer on both sides.

The gel former is in a dissolved or dispersed state in a solvent. Useful solvents include water or organic solvents, in particular those having a boiling point below 250° C. at 1 bar. Preference is given to water, water miscible organic solvents and mixtures of water with these solvents in any proportion. Water is particularly preferred. Aqueous solutions of the gel former are very particularly preferred.

A gel consists of a spatial network and a liquid occupying some or all of the interstices in the network. It is an essential feature of this invention that this spatial network is formed from the organic gel formers by polycondensation and/or polyaddition.

The liquid is preferably the aforementioned solvent, in particular water (hydrogel).

Useful gel formers are organic compounds that are chemically crosslinkable by polyaddition or polycondensation.

Polycondensation is a chemical reaction in which water is eliminated. In adduct formation, the reactants react without elimination of water or any other compound.

Examples of polyadduct formation are polyisocyanate polyaddition products, in particular polyurethanes obtained by reaction of polyisocyanates with hydroxyl or amino containing compounds in a suitable organic solvent (solvogels).

Suitable polyisocyanate polyaddition products are known for example from DE 10 2005 025 970.7 and the prior art references cited therein. To form a three-dimensional network, the functionality of the polyisocyanates, (i.e., the average number of isocyanate groups per molecule) or the functionality of the isocyanate reactive compounds (i.e., the average number of hydroxyl and amino groups per molecule) should be greater than 2, preferably greater than 2.3, and more preferably greater than 2.8.

Gels formed by polycondensation are preferred in the realm of the present invention.

The organic gel former is in particular a compound formed from aromatic hydroxy compounds and an aldehyde (phenol-aldehyde resin) or from amino compounds and an aldehyde (amino-aldehyde resin).

The phenol-aldehyde resins are preferably reaction products of a low molecular weight aldehyde (molecular weight preferably less than 200 g/mol, in particular less than 100 g/mol) with a low molecular weight aromatic hydroxy compound consisting preferably of just one aromatic ring substituted by at least one hydroxyl group and optionally by alkyl groups (molecular weight preferably less than 200, in particular less than 150 g/mol). The aldehyde is preferably formaldehyde, acetaldehyde or furfural, more preferably formaldehyde. The aromatic hydroxy compound is preferably phenol or cresol.

The amino-aldehyde resins are preferably reaction products of a low molecular weight aldehyde (molecular weight preferably less than 200 g/mol, in particular less than 100 g/mol) with a low molecular weight amino compound which comprises at least two primary amino groups (molecular weight preferably less than 200 and especially less than 150 g/mol). The aldehyde is preferably formaldehyde, acetaldehyde or furfural, more preferably formaldehyde. The amino compound is preferably urea or melamine.

The phenol-aldehyde resins and amino-aldehyde resins are preferably solutions, in particular aqueous solutions. The reaction products of the above compounds are therefore crosslinked only to such an extent, if at all, that the reaction products are still soluble in water at 20° C. and 1 bar.

Amino-aldehyde resins are very particularly preferred. The molar ratio of aldehyde group to the reactive hydrogen atoms of the amino groups (primary amino groups have two reactive H atoms) is preferably in the range from 0.08 to 2 mol of aldehyde, preferably formaldehyde, per 1 mol of amino group.

The resins can be reacted with further compounds. A particular possibility are alcohols with which the methylol groups formed in the reaction with formaldehyde can be etherified. These alcohols are then eliminated in the course of the later crosslinking, through further reaction of the methylol groups or etherified methylol groups.

Suitable amino-formaldehyde resins are obtainable for example from BASF as Kaurits®, Kauramins® and Luwipals®.

The solids content of the resin solution or dispersion is preferably between 2% and 50% by weight, and the viscosity of the solution or dispersion is less than 5000 mPas and especially less than 1000 mPas.

The dispersion or solution of the gel former may comprise further additives as well as the gel former. Useful additives include for example wetting agents to effect better distribution and uniform coating of the gel former on the support. Fluorosurfactants that reduce the surface tension on the substrate may be mentioned by way of example. The amount of wetting agent is preferably in the range from 0.1 to 3 parts by weight per 100 parts by weight of gel former (dry, without solvent). A further possibility are additives that influence the later pore size of the dried coating. Specific instances are in particular latex particles, organic or inorganic pigments, organic solvents, ionic and nonionic surfactants, etc. Further possibilities are in particular catalysts which initiate or speed the gel formation taking place in process step b). The nature of the catalysts is discussed in the following section.

Concerning Process Step b)

Gel formation is subsequently effected by chemical crosslinking. Chemical crosslinking to form the gel can be effected by temperature elevation, by irradiation with high energy light, by pH change or by addition of a catalyst or by a combination thereof.

In the case of polyisocyanate polyaddition products, the addition reaction can be catalyzed by means of organotin or organotitanium compounds. Process according to the present invention wherein chemical crosslinking is effected by temperature elevation, addition of a catalyst or by temperature elevation and addition of a catalyst.

In the case of amino-aldehyde resins, the crosslinking, i.e. the further reaction of the methylol groups or etherified methylol groups with each other or with amino groups, is catalyzed by means of sulfuric acid or formic acid for example. Crosslinking preferably takes place at temperatures in the range from 30 to 100° C.

For a suitable gel structure to form, excessive drying should be avoided during crosslinking. A high relative humidity can be used to prevent drying out of the gel during the crosslinking reaction. Preferably, therefore, the chemical crosslinking is effected at least in part, especially toward the end of the crosslinking reaction, under a relative humidity of at least 50% and more preferably of at least 70%.

A two stage process wherein the chemical crosslinking is carried on in a first stage only to such an extent that, following this first stage, the partially crosslinked polymer is still present in solution and dispersion and the viscosity of the solution or dispersion is preferably less than 5000 mPa*s. The second crosslinking stage (final crosslinking) is then preferably effected at the relative humidity specified above.

More particularly, the coating obtained after crosslinking the gel former comprises at least 10% by weight of solvent, more preferably still at least 20% by weight of solvent, based on the weight total of crosslinked gel former (gel) and solvent, before the final drying under humidity.

Concerning Process Step c)

Drying can take place after conclusion of the crosslinking step and the attendant formation of a gel. Customary drying methods can be utilized to remove the solvent, in particular water. Thermal or infrared processes are preferred.

Suitable drying temperatures are for example between 30 and 100° C.

In the drying step, the solvent (water) is generally removed completely or down to a residual level of less than 3% by weight, in particular less than 0.5% by weight and more preferably less than 0.1% by weight, based on the weight total of gel and any residual solvent.

The gel finally obtained preferably comprises pores. Small pores less than 10 μm are of particular importance for use as printable substrate. The diameter of these small pores is in particular in the range from 10 nm to 1 μm.

The fraction of these small pores is preferably at least 10% by volume at 20° C., and more preferably at least 20% by volume and the fraction is generally less than 70% by volume. The % by volume is based on the total volume of the porous gel or of the porous gel layer after drying.

The size and volume fraction of the pores is determined by the method of mercury intrusion in accordance with German standard specification DIN 66133. In this method, mercury is pressed into a sample of the gel. Small pores require a higher pressure for filling with Hg than large pores, and a pore size distribution can be derived from the corresponding pressure/volume diagram.

The density of the gel is preferably 500 g/dm3 to 1200 g/dm$^3$ (20° C.)

The thickness of the dried gel layer is preferably between 1 to 50 μm.

As well as the crosslinked gel former, the gel layer may comprise further substituents (see above). The presence of pigments, especially inorganic pigments, is not necessary in the realm of this invention to achieve satisfactory or good performance characteristics, however. Pigments, if included at all, are therefore preferably included in an amount of less than 40% by weight, more preferably less than 20% by weight and especially less than 10% by weight, based on the sum total of all constituents of the gel layer (dry). The pigment content is very particularly preferably less than 5% by weight and especially less than 2% by weight, based on the sum total of all constituents of the gel layer (dry). A particularly preferred embodiment completely omits pigments from the gel layer.

The gel layer (dry) comprises in particular more than 50% by weight, more preferably more than 70% by weight and most preferably more than 90% by weight or more than 95% by weight of the crosslinked gel former, preferably of the polyaddition or polycondensation crosslinked gel former, especially of the above defined phenol-aldehyde resins or amino-aldehyde resins.

Concerning Use

The recording materials obtainable by the process of the present invention are printable, in particular with an ink jet printer. More preferably, the above gel layer serves as ink receiving layer in these recording materials.

It is particularly preferable for the ink receiving layer to be formed of a gel crosslinked by polycondensation or polyaddition.

It is very particularly preferred for the ink receiving layer to be formed of a crosslinked phenol-aldehyde resin or amino-aldehyde resin.

Recording materials, especially for ink jet printing, preferably have the following layer construction in which the order of the layers from a) to f) corresponds to the spatial arrangement:

a) if appropriate a barrier layer, for example of polyethylene (back of base paper)
b) base paper
c) a barrier layer, for example polyethylene (front of base paper)
d) gel layer according to the invention as ink receiving layer
e) if appropriate further a porous or porous layers for fixing the dye, as tie layers, interlayers
f) if appropriate a porous covering layer for protecting the layers against soiling, scratching, abrasion, etc., for adjustment of surface gloss, of gliding properties, for improving the bonding of pigmented inks etc.

The recording materials are particularly useful for printing by ink jet printer. The gel layer of the present invention permits substantial or complete omission of inorganic pigments from these substrates; at the same time, very good print quality is achieved.

EXAMPLES

Example 1

A solution of a melamine-formaldehyde condensate having a melamine/formaldehyde molar ratio of 1/1.5 was set in a 1000 ml glass beaker with twice distilled water as a 39.9% by weight low viscosity solution. 30 ml of this solution were admixed with 8.2 g of 37% by weight HCl and 100 μl of Zonyl® fluorosurfactant from DuPont and thoroughly commixed. The reactive solution was subsequently heated to 60° C. in a water bath for about 15 min and, once a honeylike viscosity had been reached, applied by means of a manually operated doctor atop a PE coated base paper in a layer thickness of 100 μm. Immediately after coating, the gel-coated paper was aged at about 600 and 60% relative humidity for 180 min. Thereafter, the paper was placed in a drying cabinet and dried at 85° C. for 120 min. The paper thus coated was printed with a Canon printer (printer settings: photopaper, best print quality) and exhibited good ink absorption and good print appearance.

Example 2

A solution of a melamine-formaldehyde condensate having a melamine/formaldehyde molar ratio of 1/1.5 was set in a 1000 ml glass beaker with twice distilled water as a 36% by weight low viscosity solution. 30 ml of this solution were admixed with 3 g of formic acid and 100 μl of Zonyl® fluorosurfactant from DuPont and thoroughly commixed. The reactive solution was subsequently heated to 80° C. in a water bath for 100 min and subsequently applied by means of a manually operated doctor atop a PE coated base paper in a layer thickness of 100 μm. Immediately after coating, the gel-coated paper was aged at about 500 and 75% relative humidity for 110 min. Thereafter, the paper was placed at room temperature and dried. The paper thus coated was printed with an ink jet printer from Hewlett Packard (HP2300) (printer settings: photopaper, best print quality) and exhibited good ink absorption and good print appearance compared with a conventional photopaper based on a silicate coating (see "Reference paper" column).

The values hereinbelow describe print appearance:

| | | Reference paper | Example 2 |
|---|---|---|---|
| Roughness (black on paper) | μm | 5 | 7 |
| Roughness (black on yellow) | μm | 6 | 7 |
| Line width (black on paper) | μm | 358 | 354 |
| Line width (black on yellow) | μm | 362 | 353 |
| Roughness (blue on paper) | μm | 10 | 8 |
| Roughness (blue on yellow) | μm | 7 | 8 |
| Line width (blue on paper) | μm | 331 | 330 |
| Line width (blue on yellow) | μm | 348 | 339 |

Volume Fraction of Pores

The volume fraction of pores was determined using mercury intrusion by the method of German standard specification DIN 66133. The paper coated in accordance with the present invention and obtained according to Example 2 has a high volume fraction of pores less than 1 μm in diameter, in contradistinction to the uncoated base paper.

We claim:

1. A process for producing a recording material that has a gel layer, comprising:

a) coating a support with a dispersion or solution of an organic gel former that is chemically crosslinkable by polycondensation or polyadduct formation wherein the organic gel former is a member selected from the group consisting of a compound formed from aromatic hydroxy compounds and an aldehyde, a compound formed from amino compounds and an aldehyde, and combinations of a polyisocyanate with hydroxyl or amino containing compounds;
b) chemically crosslinking the gel former by polycondensation or polyadduct formation, at least in part at a relative humidity of at least 50%, to form a gel; and
c) drying the gel.

2. The process according to claim 1 wherein the gel former is a compound that is crosslinkable by polycondensation.

3. The process according to claim 1 wherein the organic gel former is a compound formed from aromatic hydroxy compounds and an aldehyde or from amino compounds and an aldehyde.

4. The process according to claim 3, wherein the organic gel former is a phenol-aldehyde resin or an amino-aldehyde resin.

5. The process according to claim 1 wherein the gel former is an amino-formaldehyde resin.

6. The process according to claim 5 wherein the amino-formaldehyde resin is an urea-formaldehyde resin or a melamine-formaldehyde resin.

7. The process according to claim 5 wherein the amino-formaldehyde resin has a formaldehyde content of 0.08 to 2 mol of formaldehyde per mol of amino group.

8. The process according to claim 1 wherein the dispersion or solution of the gel former comprises water, a water miscible organic solvent, or a mixture thereof as solvent.

9. The process according to claim 8 wherein the dispersion or solution further comprises wetting agents or additives that influence later pore sizes of a dried coating.

10. The process according to claim 1 wherein the support is a cellulosic support material.

11. The process according to claim 10 wherein the support is a paper coated with a barrier layer.

12. The process according to claim 11 wherein the barrier layer is polyethylene.

13. The process according to claim 1 wherein said chemically crosslinking is conducted by temperature elevation, by irradiation, by pH change, by addition of a catalyst or by a combination thereof.

14. The process according to claim 1 wherein said chemically crosslinking is conducted at least partly at temperatures ranging from 30 to 100° C.

15. The process according to claim 1 wherein said chemically crosslinking comprises:

(1) partially crosslinking the gel former so that the viscosity of the dispersion or solution is at most 5000 mPa·s, and (2) further crosslinking the gel former at a relative humidity of at least 50%.

16. The process according to claim 1 wherein a coating obtained after the crosslinking of the gel former comprises at least 10% by weight of solvent, based on the weight total of crosslinked gel former and solvent, before the drying.

17. The process according to claim 1 wherein the gel after drying comprises at least 10% by volume of pores having a diameter of less than 10 μm, based on the total volume of the gel layer.

18. The process according to claim 1 wherein the gel layer, after drying, has a thickness ranging from 1 to 50 μm.

* * * * *